US007694387B1

(12) United States Patent
Huang

(10) Patent No.: US 7,694,387 B1
(45) Date of Patent: Apr. 13, 2010

(54) RETRACTABLE HANDLE ASSEMBLY

(75) Inventor: Yao-Chung Huang, Fu Shing Hsiang (TW)

(73) Assignee: Ho Cheng Garden Tools Co., Ltd., Changhua Hsien (TW)

( * ) Notice: Subject to any disclaimer, the term of this patent is extended or adjusted under 35 U.S.C. 154(b) by 657 days.

(21) Appl. No.: 11/646,974

(22) Filed: Dec. 28, 2006

(51) Int. Cl.
*B25G 1/04* (2006.01)

(52) U.S. Cl. ..... 16/113.1; 16/429

(58) Field of Classification Search ..... 16/113.1, 16/405, 429, 436; 15/143.1, 144.1, 144.3, 15/144.4; 30/250, 249, 296.1, 340, 341; 81/177.1, 177.2, 489; 294/19.1, 19.3, 19.2, 294/57; 190/18 A, 105; 74/551.1, 536, 543, 74/544, 551.3, 551.4; 403/109.1, 109.8, 403/377, 383

See application file for complete search history.

(56) References Cited

U.S. PATENT DOCUMENTS 2,595,597 A * 5/1952 Morseth ..... 285/302
4,653,142 A * 3/1987 Upton ..... 16/429
5,228,202 A * 7/1993 Liao ..... 30/249
5,336,012 A * 8/1994 Newville ..... 401/289
5,515,574 A * 5/1996 Larson ..... 16/429
6,588,296 B2 * 7/2003 Wessel ..... 74/502.2
6,675,674 B2 * 1/2004 Wang ..... 74/531
6,842,983 B1 * 1/2005 Hsu ..... 30/231
2006/0193679 A1 * 8/2006 Lin ..... 403/109.5
2006/0282988 A1 * 12/2006 Lin ..... 16/429

* cited by examiner

*Primary Examiner*—Chuck Y. Mah
(74) *Attorney, Agent, or Firm*—Alan Kamrath; Kamrath & Associates PA

(57) ABSTRACT

A retractable handle assembly includes a shank, an extension pipe, a retractable pipe, a receiving member, an expandable member, a control member, a driving member, and a rotation member. The retractable pipe is movable relative to the extension pipe by rotation of the rotation member to adjust the distance between the retractable pipe and the extension pipe so as to adjust the length of the retractable handle assembly. Thus, when each of the push flanges of the control member is inserted into the respective locking recess of the expandable member by rotation of the control member, the control member is locked by the expandable member, thereby preventing the control member from being jammed due to an excessive rotation.

17 Claims, 11 Drawing Sheets

RETRACTABLE HANDLE ASSEMBLY

BACKGROUND OF THE INVENTION

1. Field of the Invention

The present invention relates to a retractable handle assembly and, more particularly, to a retractable handle assembly available for a hand tool, a gardening tool and the like.

2. Description of the Related Art

A conventional retractable handle assembly for a gardening tool in accordance with the prior art shown in FIGS. 9-11 comprises a shank 100, an extension pipe 110 mounted in the shank 100, a retractable pipe 120 movably mounted in the extension pipe 110, a mounting seat 160 mounted on the lower end of the retractable pipe 120 to move therewith and having a hollow inside having an upper portion formed with a screw bore 1610 and a lower portion formed with a tapered opening 1620, two locking blocks 170 pivotally mounted in the tapered opening 1620 of the mounting seat 160, a control head 150 mounted on the mounting seat 160 and having an upper portion formed with an outer thread 1510 screwed into the screw bore 1610 of the mounting seat 160 and a lower portion formed with a tapered pressing face 1520 that is movable to press the tapered opening 1620 of the mounting seat 160 and the locking blocks 170, a control rod 140 rotatably mounted in the shank 100 and extended through the control head 150 to rotate the control head 150, and a rotation member 130 rotatably on the lower end of the shank 100 and secured on the lower end of the control rod 140 to rotate the control rod 140.

As shown in FIGS. 9 and 10, the retractable pipe 120 is movable relative to the extension pipe 110 to adjust the distance between the retractable pipe 120 and the extension pipe 110 so as to adjust the whole length of the retractable handle assembly.

As shown in FIGS. 9 and 11, when the control rod 140 is rotated by the rotation member 130, the control head 150 is rotated relative to the mounting seat 160, so that the outer thread 1510 of the control head 150 is further screwed into the screw bore 1610 of the mounting seat 160, and the tapered pressing face 1520 of the control head 150 is movable to press the tapered opening 1620 of the mounting seat 160 and the locking blocks 170 to press the inner wall of the extension pipe 110 so as to lock the retractable pipe 120 onto the extension pipe 110.

However, when the rotation member 130 is rotated to an excessive extent, the outer thread 1510 of the control head 150 is deeply screwed into the screw bore 1610 of the mounting seat 160, so that the outer thread 1510 of the control head 150 is easily jammed with the screw bore 1610 of the mounting seat 160, thereby causing the retractable handle assembly inoperative. In addition, the locking blocks 170 press the inner wall of the extension pipe 110, so that when the retractable pipe 120 is pressed downward, the locking blocks 170 are easily jammed with the inner wall of the extension pipe 110, thereby affecting operation of the rotation member 130.

BRIEF SUMMARY OF THE INVENTION

In accordance with the present invention, there is provided a retractable handle assembly, comprising a shank, an extension pipe mounted in the shank, a retractable pipe movably mounted in the extension pipe, a receiving member mounted on the retractable pipe to move therewith, an expandable member mounted on the receiving member to move therewith, a control member extended through the expandable member and rotatable between a first position where the expandable member is pressed outwardly by the control member to press the extension pipe so as to lock the retractable pipe onto the extension pipe and a second position where the expandable member is loosened from the control member to release the extension pipe so as to unlock the retractable pipe from the extension pipe, a driving member secured on the control member to rotate the control member, and a rotation member rotatably on the shank and connected to the driving member to rotate the driving member.

The primary objective of the present invention is to provide a retractable handle assembly, wherein the retractable pipe is movable relative to the extension pipe by rotation of the rotation member to adjust the distance between the retractable pipe and the extension pipe so as to adjust the whole length of the retractable handle assembly, thereby facilitating a user operating the gardening tool.

Another objective of the present invention is to provide a retractable handle assembly, wherein when the control member is rotated by the rotation member, each of the push flanges of the control member is movable to press the resting portion of the respective flexible arm of the expandable member to push the pressing portion of the respective flexible arm of the expandable member to press the inner wall of the extension pipe so as to lock the retractable pipe onto the extension pipe.

A further objective of the present invention is to provide a retractable handle assembly, wherein when each of the push flanges of the control member is inserted into the locking recess of the respective flexible arm of the expandable member by rotation of the control member, the control member is locked by the expandable member, thereby preventing the control member from being jammed due to an excessive rotation.

A further objective of the present invention is to provide a retractable handle assembly, wherein when the control member is locked by the expandable member, the rotation member is locked by the control member, thereby preventing the rotation member from being rotated freely.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
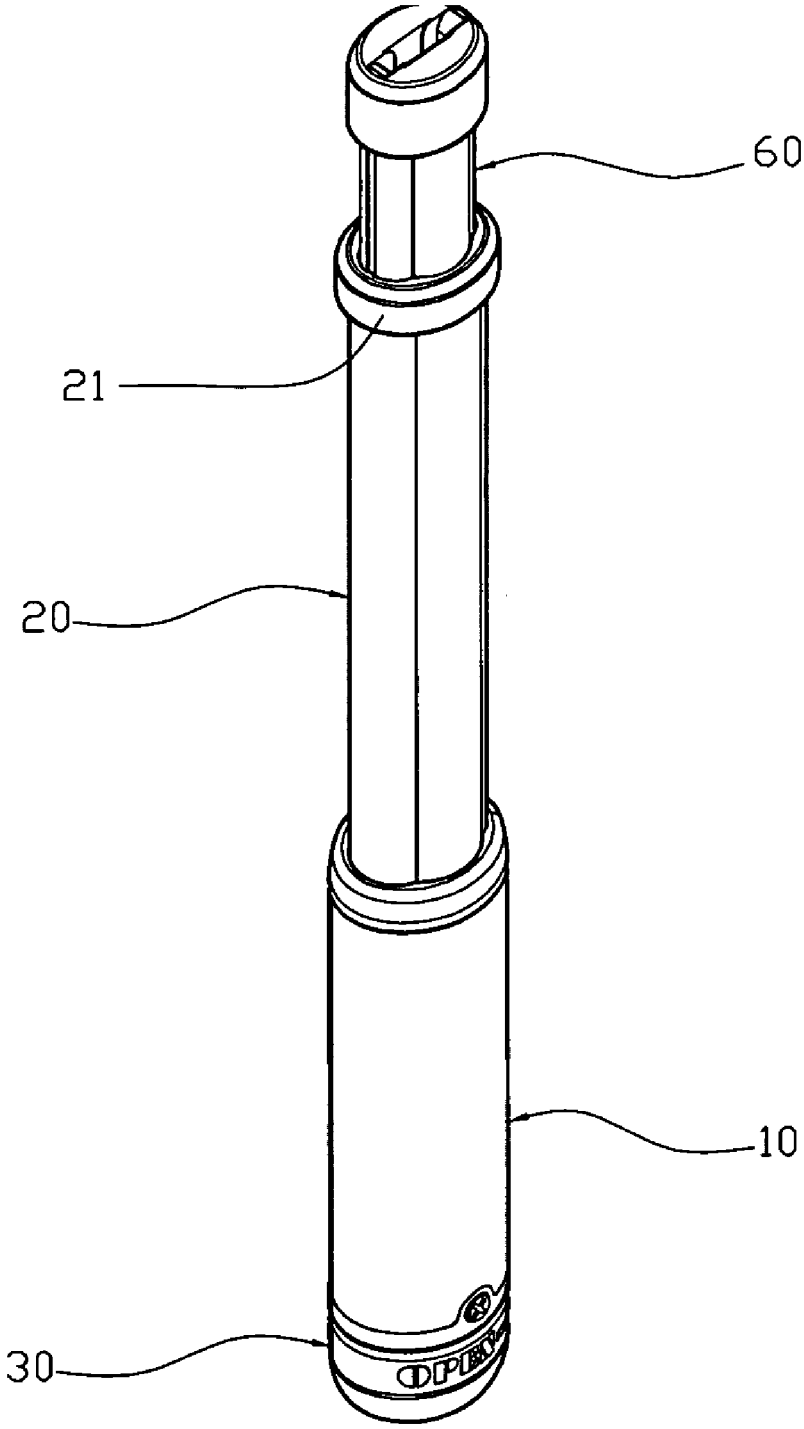
FIG. 1 is a perspective view of a retractable handle assembly in accordance with the preferred embodiment of the present invention.
Figure 2:
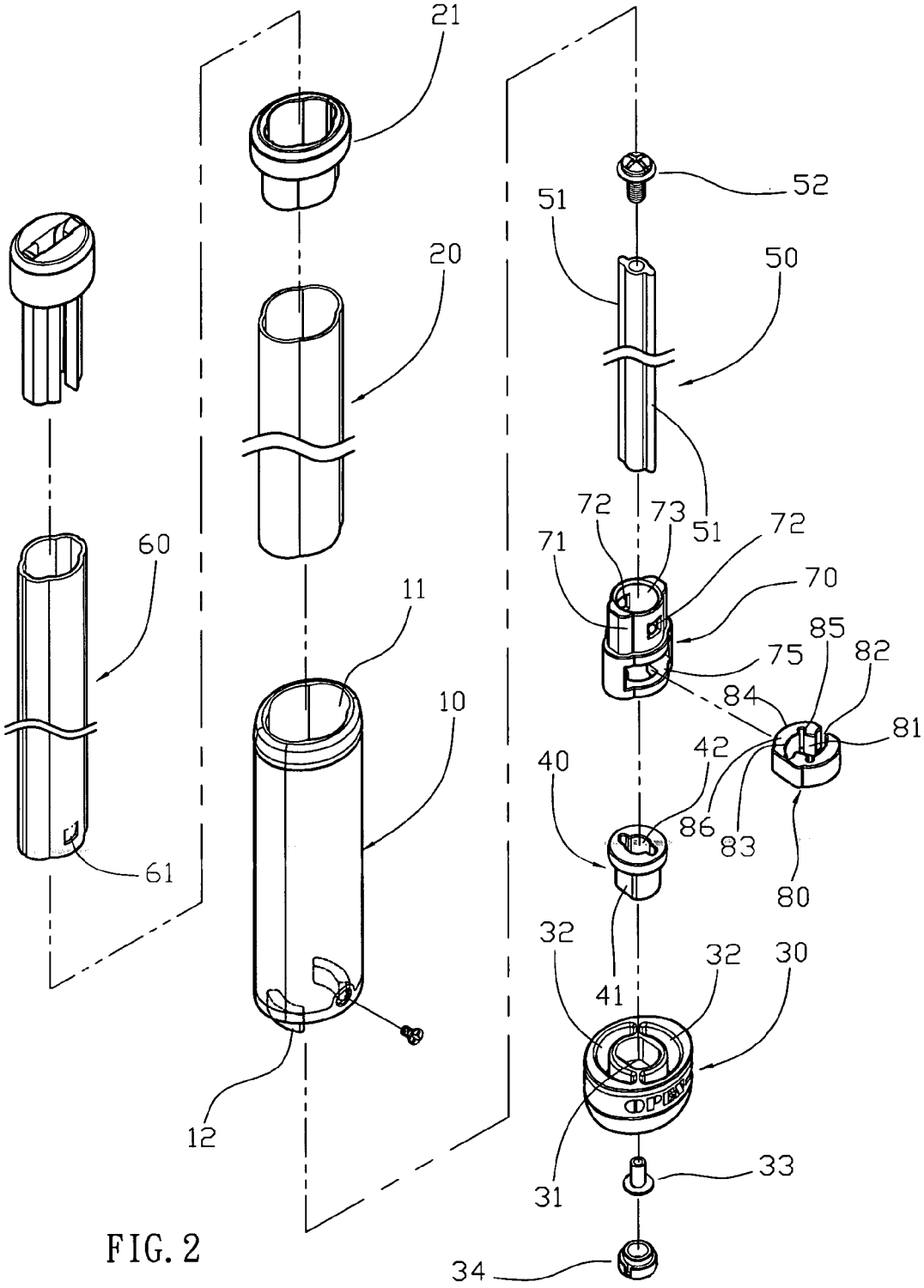
FIG. 2 is an exploded perspective view of the retractable handle assembly as shown in FIG. 1.
Figure 3:
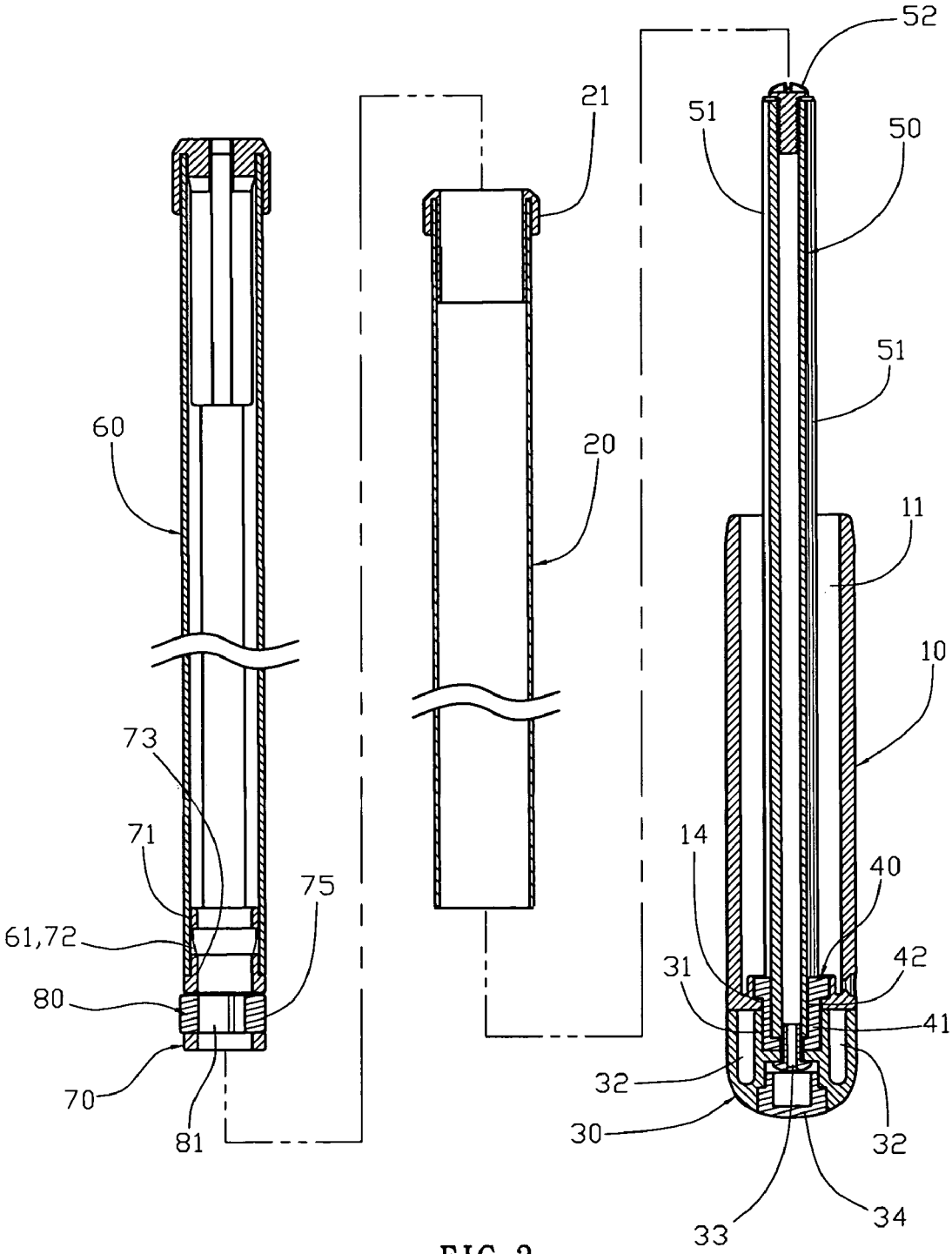
FIG. 3 is a front exploded cross-sectional view of the retractable handle assembly as shown in FIG. 1.

Referring to the drawings and initially to FIGS. 1-5, a retractable handle assembly in accordance with the preferred embodiment of the present invention comprises a shank 10, an extension pipe 20 mounted in the shank 10, a retractable pipe 60 movably mounted in the extension pipe 20, a receiving member 70 mounted on the retractable pipe 60 to move therewith, an expandable member 80 mounted on the receiving member 70 to move therewith, a control member 50 extended through the expandable member 80 and rotatable between a first position where the expandable member 80 is pressed outwardly by the control member 50 to press the extension pipe 20 so as to lock the retractable pipe 60 onto the extension pipe 20 and a second position where the expandable member 80 is loosened from the control member 50 to release the extension pipe 20 so as to unlock the retractable pipe 60 from the extension pipe 20, a driving member 40 secured on the control member 50 to rotate the control member 50, and a rotation member 30 rotatably on the shank 10 and connected to the driving member 40 to rotate the driving member 40.

The shank 10 has an inside formed with a non-circular positioning hole 11 to position the extension pipe 20 and has a lower end provided with two limit studs 12. The positioning hole 11 of the shank 10 has a bottom formed with a passage 14.

The extension pipe 20 partially protrudes outwardly from the shank 10 and has a non-circular cross-sectional shape matching that of the shank 10. A sleeve 21 is mounted on an upper end of the extension pipe 20.

The rotation member 30 is rotatably on the lower end of the shank 10. The rotation member 30 has an inside formed with a counterbore 31 and has a peripheral wall formed with two limit slots 32 to receive the limit studs 12 of the shank 10.

The driving member 40 has an inside formed with a fixing hole 42 fixed on the control member 50. The driving member 40 has a first end received in the shank 10 and a second end 41 extended through the passage 14 of the shank 10 and fixed in the counterbore 31 of the rotation member 30.

The retractable handle assembly further comprises a locking screw 33 extended through the rotation member 30 and the second end 41 of the driving member 40 and screwed into the control member 50 to combine the rotation member 30, the driving member 40 and the control member 50 together, and an end cap 34 mounted in the counterbore 31 of the rotation member 30 to cover the locking screw 33.

The receiving member 70 has an inside formed with a channel 73 to allow passage of the control member 50 and has a first end 71 inserted into the retractable pipe 60 and a second end formed with a receiving chamber 75 connected to the channel 73 to receive the expandable member 80. The first end 71 of the receiving member 70 has a peripheral wall formed with two locking bores 72.

The retractable pipe 60 partially protrudes outwardly from the extension pipe 20 and has a non-circular cross-sectional shape matching that of the extension pipe 20. The retractable pipe 60 has a lower end formed with two locking bosses 61 snapped into the locking bores 72 of the receiving member 70.

The expandable member 80 has two opposite flexible arms 86 each having a first face formed with a substantially arc-shaped resting portion 83 and a locking recess 85 and a second face formed with a pressing portion 84 that is movable to press an inner wall of the extension pipe 20. The expandable member 80 has an inside formed with a conduit 81 to allow passage of the control member 50. The conduit 81 of the expandable member 80 is located between the flexible arms 86 and has a side formed with a slit 82 so that the flexible arms 86 are made elastic.

The control member 50 has a first end secured in the fixing hole 42 of the driving member 40 to rotate therewith and a second end provided with a catch member 52. The control member 50 has a periphery formed with two opposite push flanges 51 each movable by rotation of the control member 50 to press the resting portion 83 of a respective flexible arm 86 of the expandable member 80 to push the pressing portion 84 of the respective flexible arm 86 of the expandable member 80 toward the extension pipe 20. Each of the push flanges 51 of the control member 50 is inserted into and detachably locked in the locking recess 85 of the respective flexible arm 86 of the expandable member 80 by rotation of the control member 50 to lock the control member 50 onto the expandable member 80.

Figure 4:
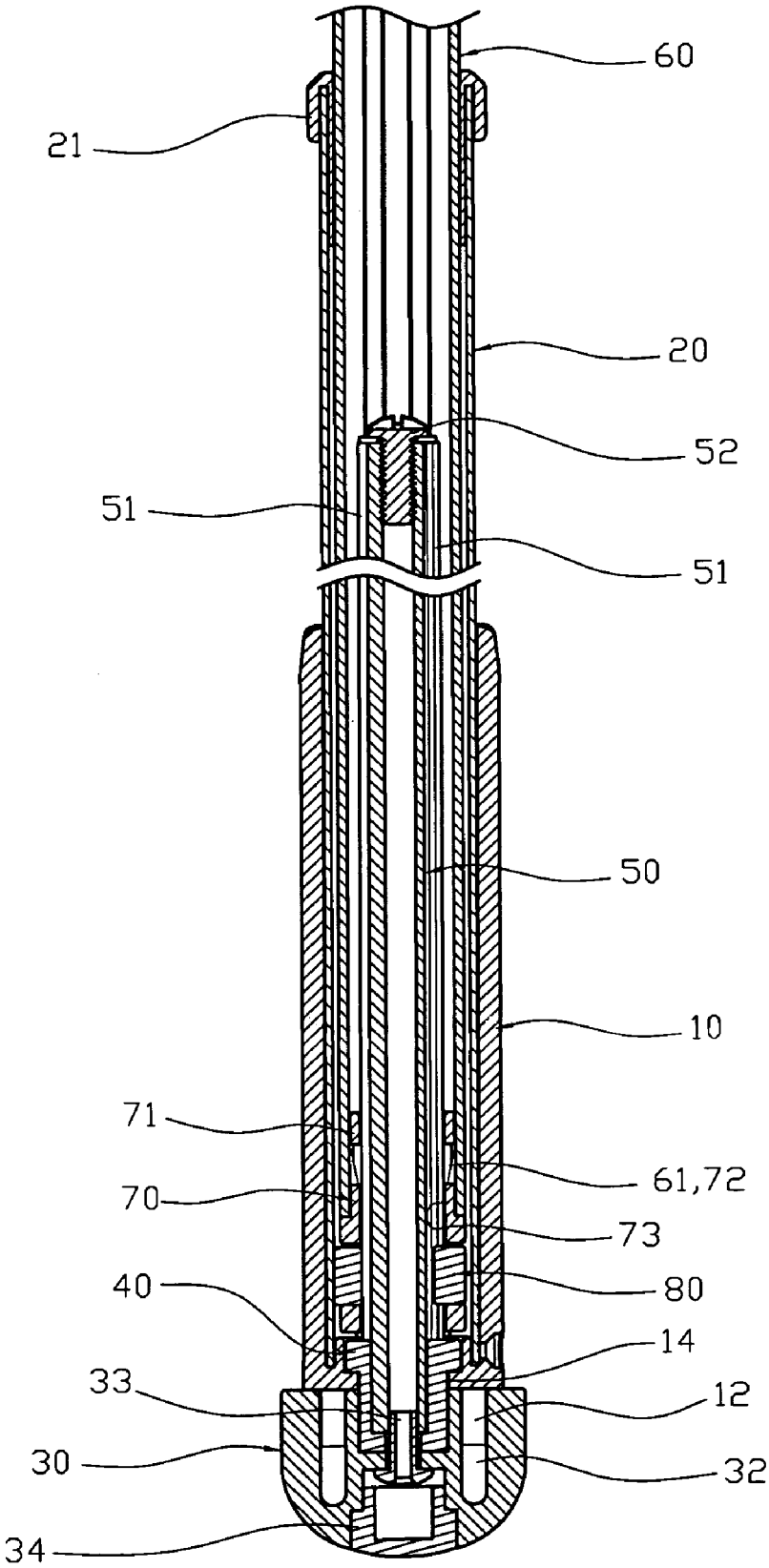
FIG. 4 is a partially cut-away cross-sectional operational view of the retractable handle assembly as shown in FIG. 1.
Figure 5:
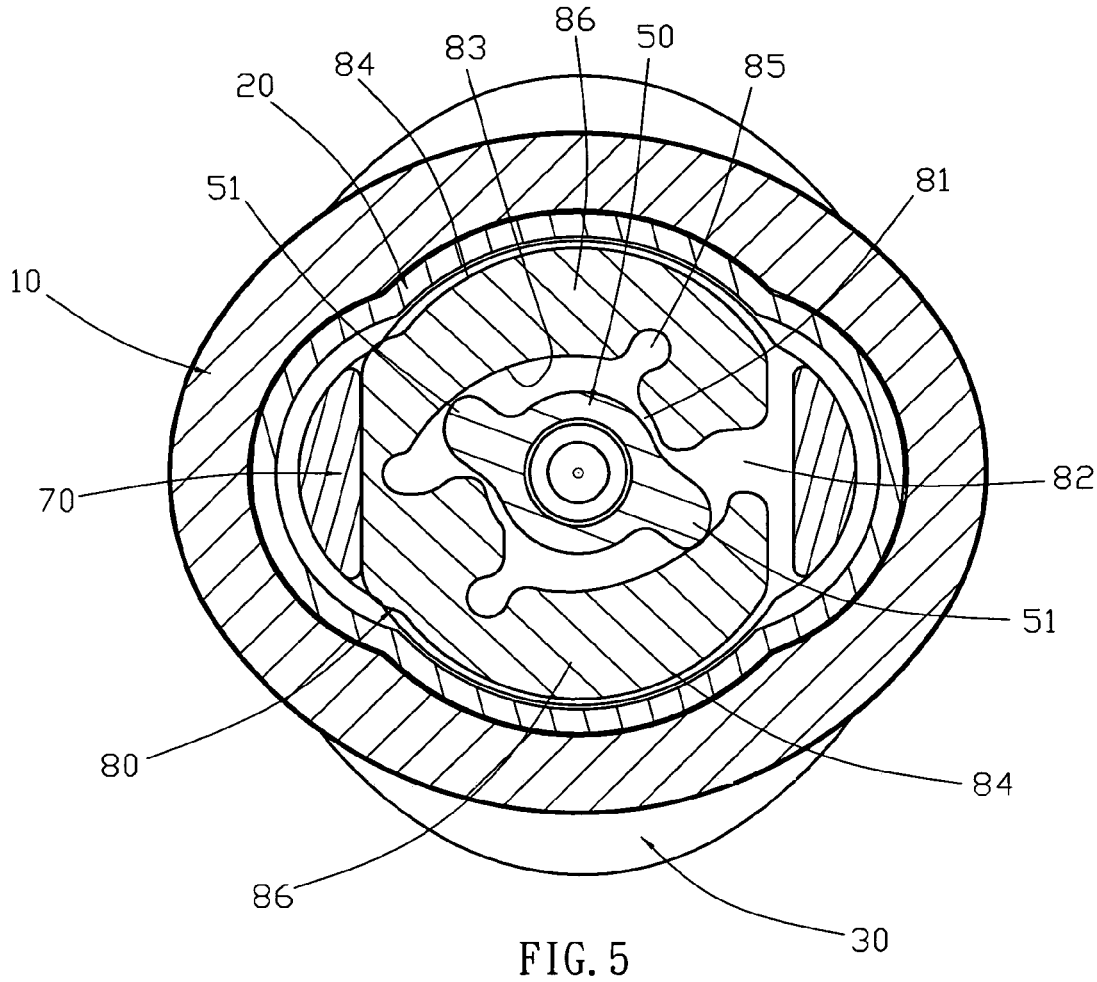
FIG. 5 is a top cross-sectional view of the retractable handle assembly as shown in FIG. 4.

As shown in FIGS. 4 and 5, each of the push flanges 51 of the control member 50 is detached from the resting portion 83 of the respective flexible arm 86 of the expandable member 80 to detach the pressing portion 84 of the respective flexible arm 86 of the expandable member 80 from the inner wall of the extension pipe 20 so as to unlock the retractable pipe 60 from the extension pipe 20, so that the retractable pipe 60 is movable relative to the extension pipe 20 to adjust a distance between the retractable pipe 60 and the extension pipe 20 so as to adjust the whole length of the retractable handle assembly.

Figure 6:
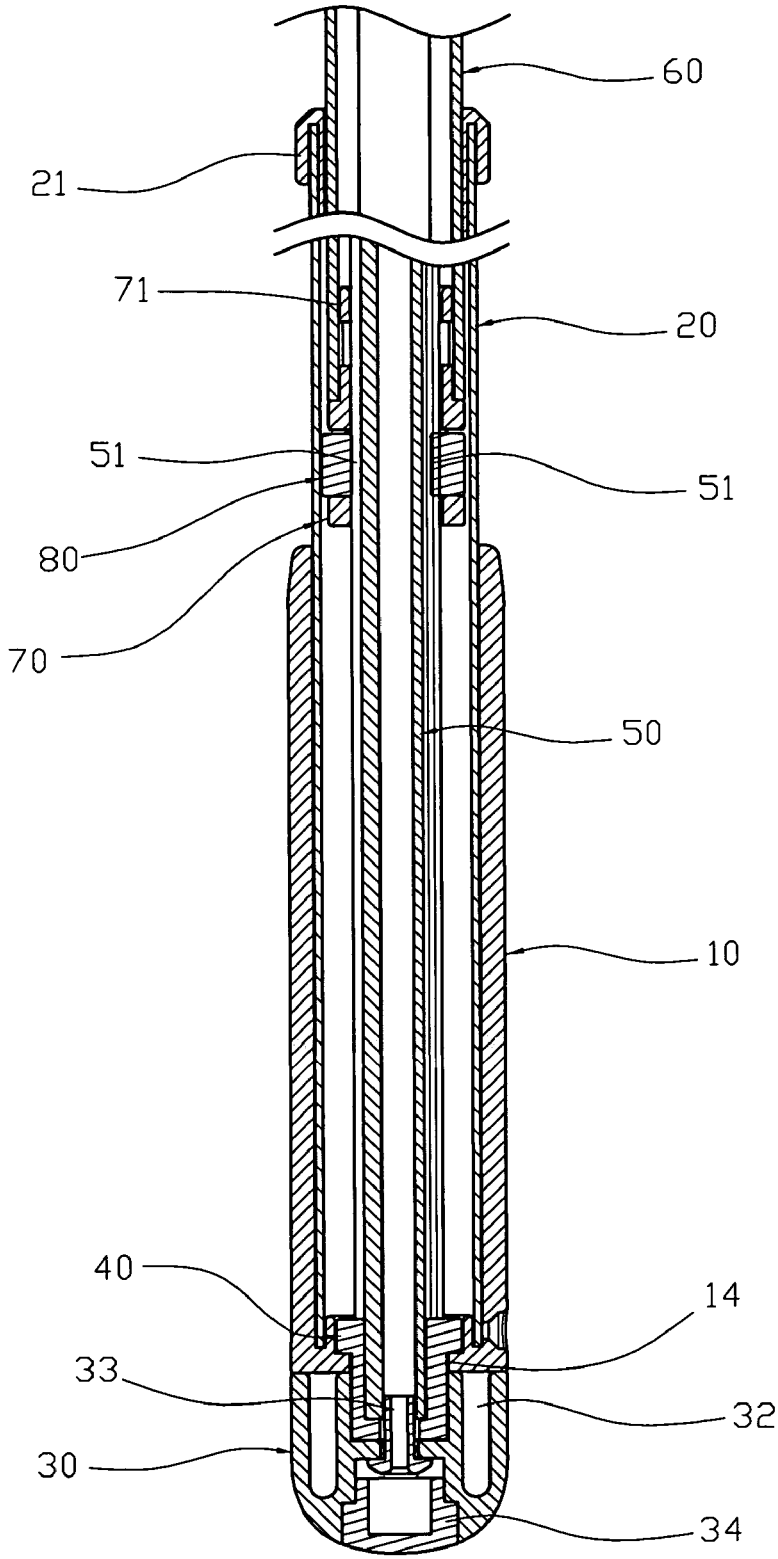
FIG. 6 is a schematic operational view of the retractable handle assembly as shown in FIG. 4.
Figure 7:
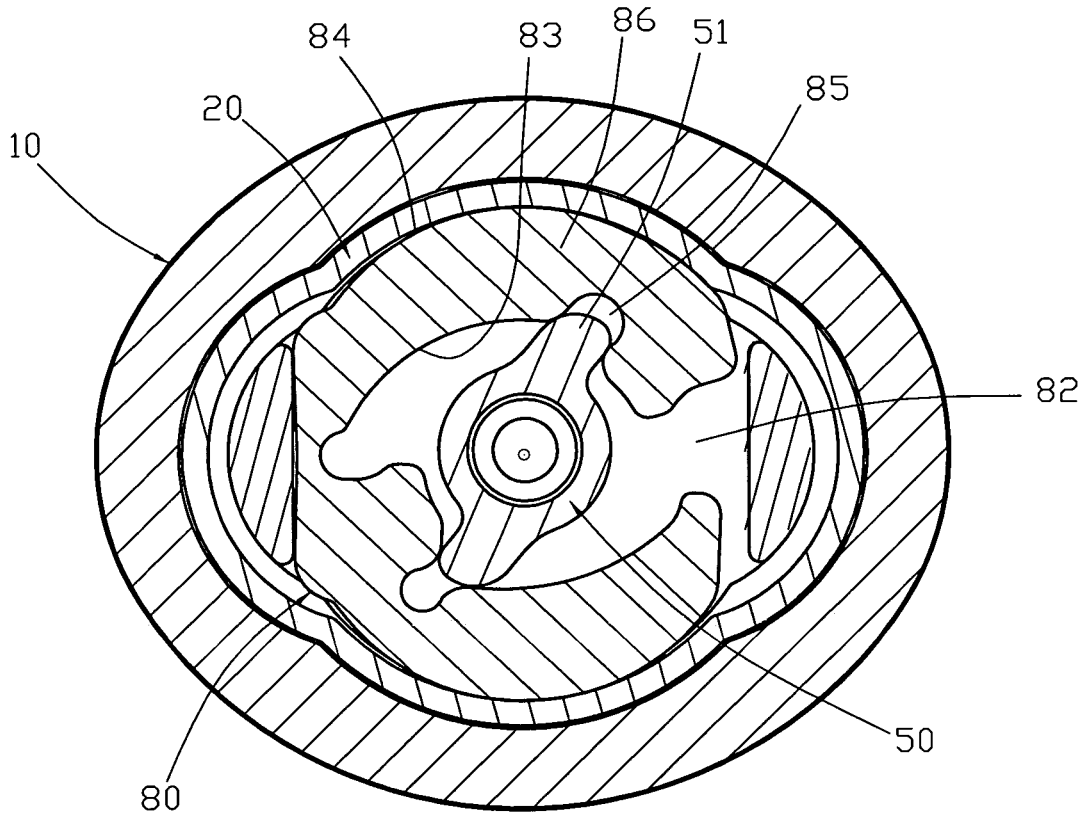
FIG. 7 is a schematic operational view of the retractable handle assembly as shown in FIG. 5.

As shown in FIGS. 6 and 7, when the control member 50 is rotated by the rotation member 30, each of the push flanges 51 of the control member 50 is movable to press the resting portion 83 of the respective flexible arm 86 of the expandable member 80 to push the pressing portion 84 of the respective flexible arm 86 of the expandable member 80 to press the inner wall of the extension pipe 20 so as to lock the retractable pipe 60 onto the extension pipe 20. At this time, when each of the push flanges 51 of the control member 50 is inserted into and locked in the locking recess 85 of the respective flexible arm 86 of the expandable member 80 by rotation of the control member 50, the control member 50 is locked by the expandable member 80. In addition, the limit studs 12 of the shank 10 are rotatable in the limit slots 32 of the rotation member 30 to limit rotation of the rotation member 30.

Figure 8:
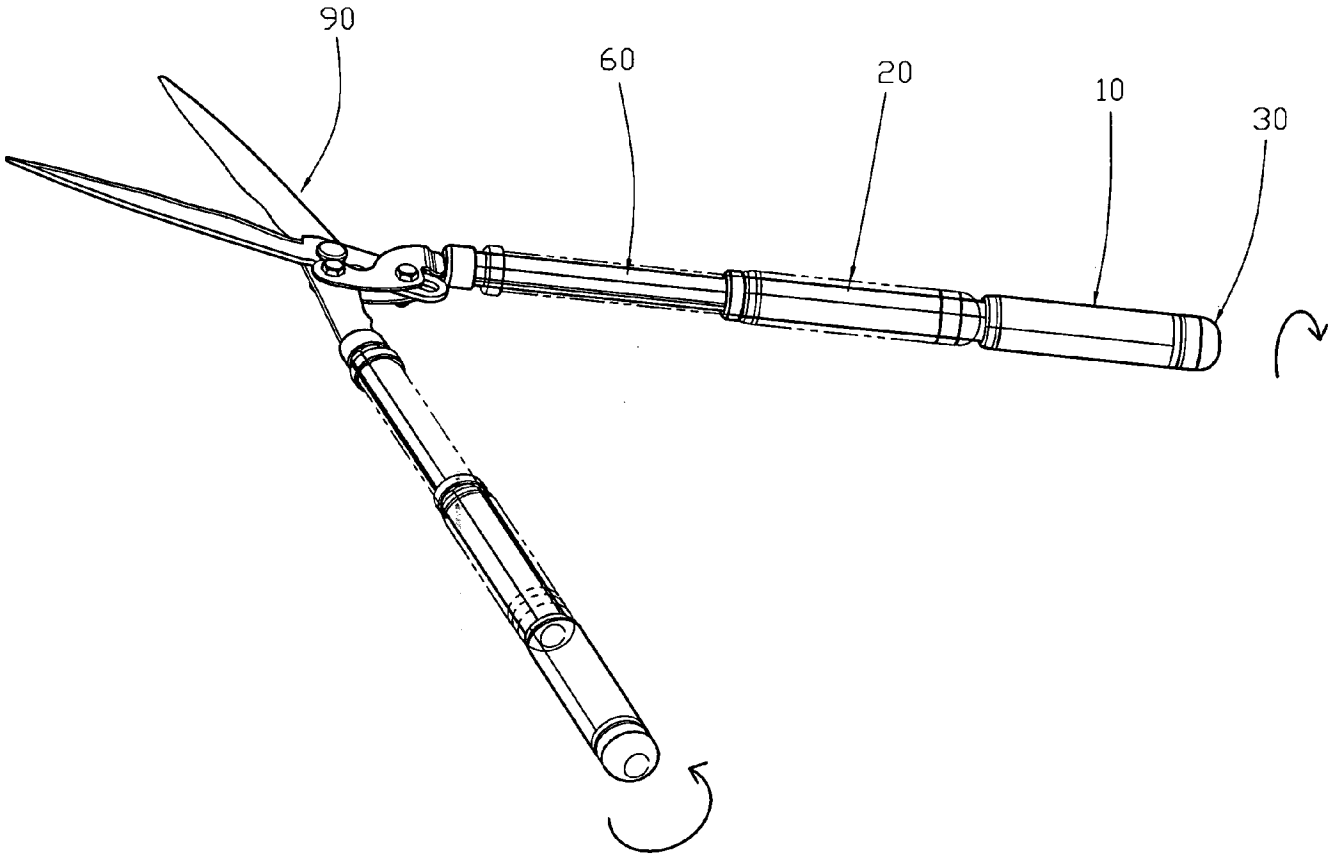
FIG. 8 is a perspective view showing the retractable handle assembly as shown in FIG. 1 is used for a gardening tool.
Figure 9:
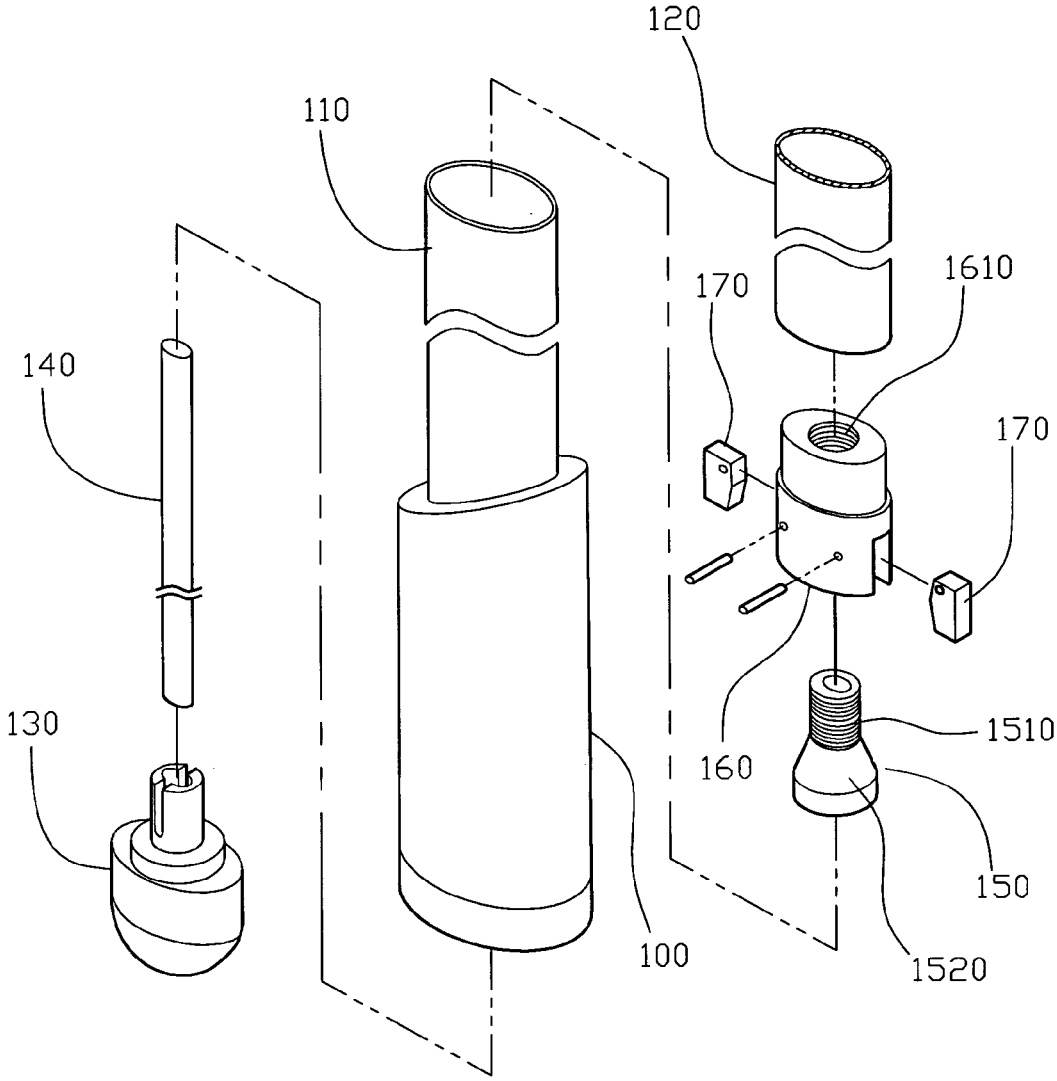
FIG. 9 PRIOR ART
FIG. 9 is an exploded perspective view of a conventional retractable handle assembly in accordance with the prior art.
Figure 10:
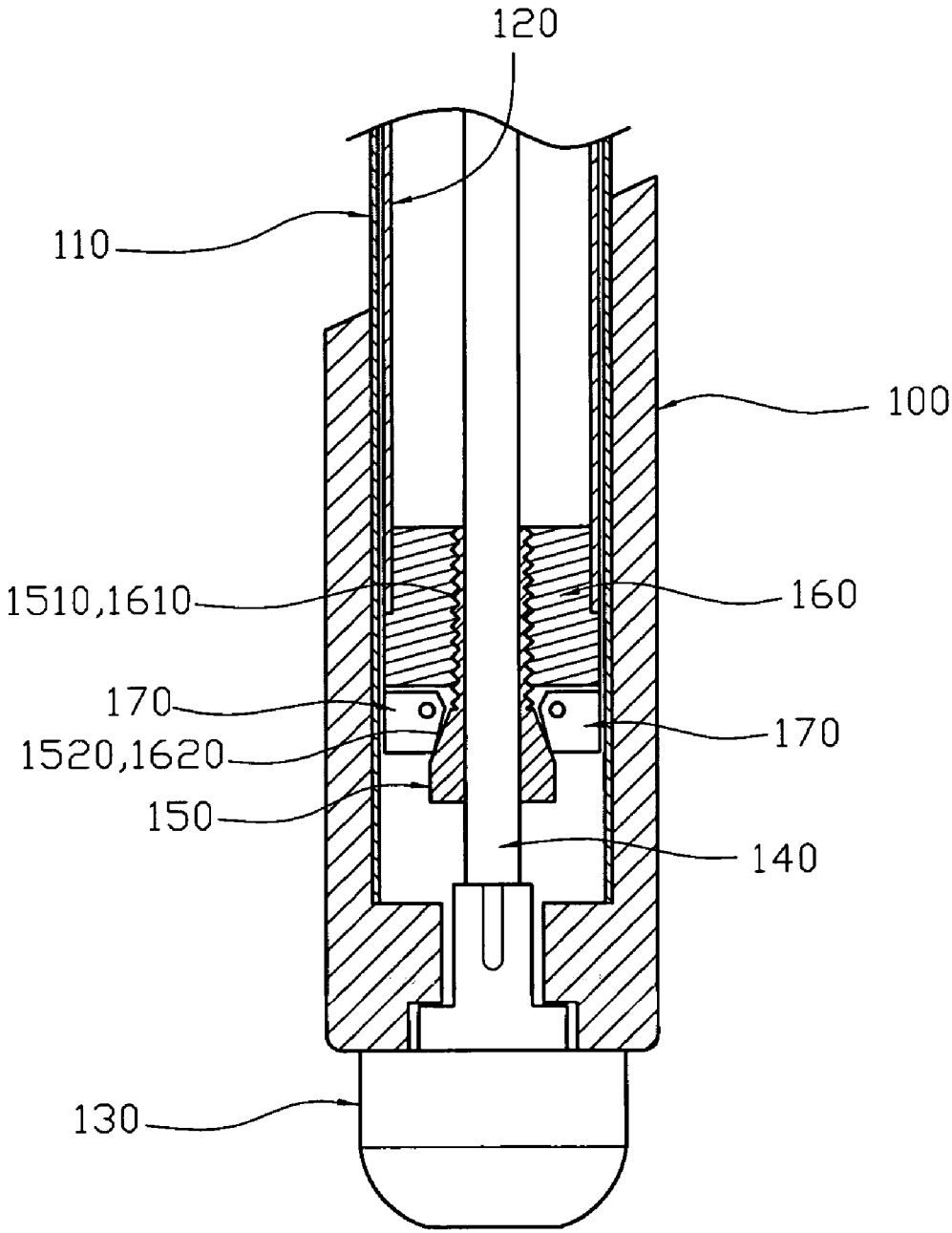
FIG. 10 PRIOR ART
FIG. 10 is a front cross-sectional assembly view of the conventional retractable handle assembly as shown in FIG. 9.
Figure 11:
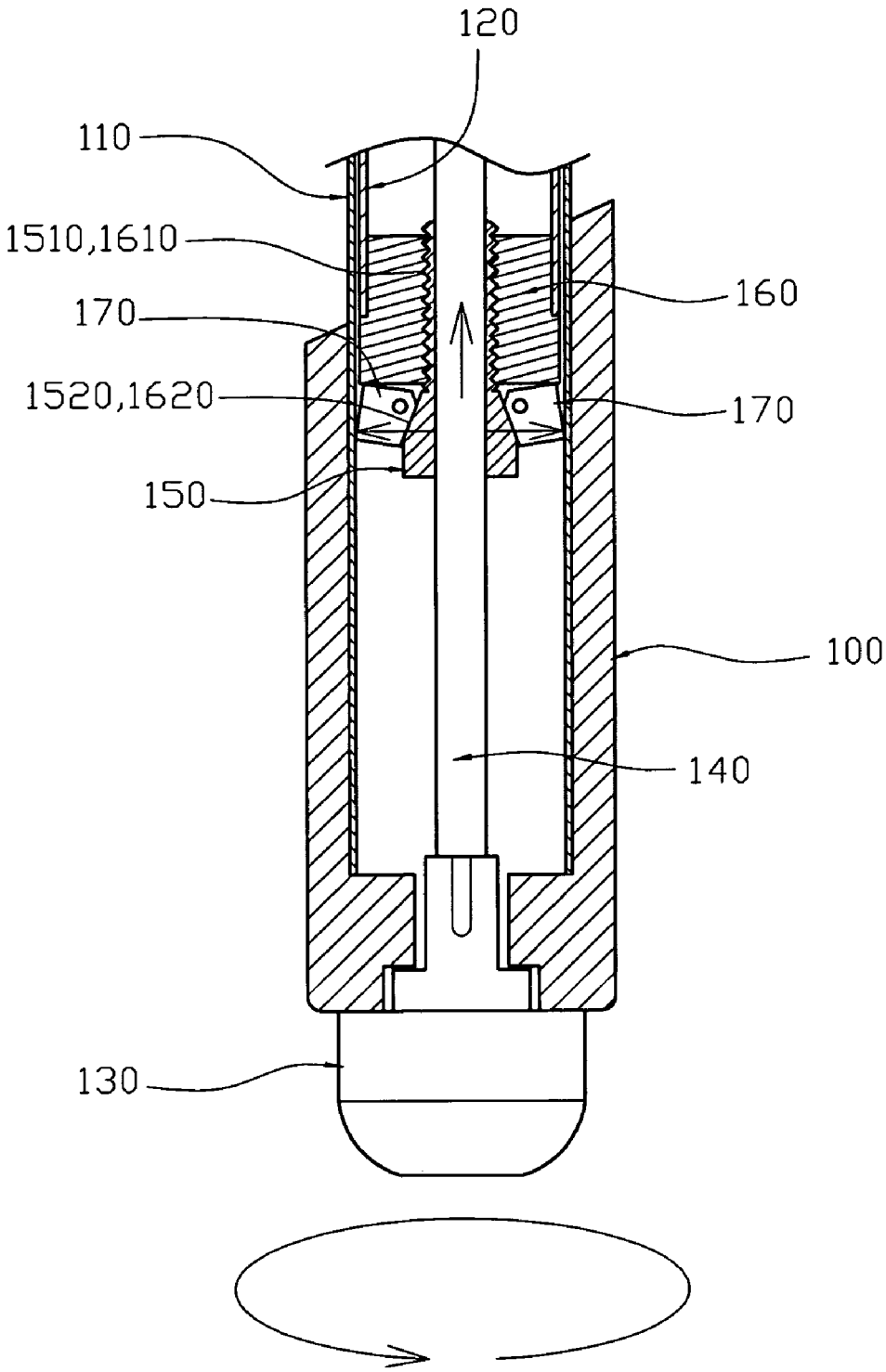
FIG. 11 PRIOR ART
FIG. 11 is a schematic operational view of the conventional retractable handle assembly as shown in FIG. 10.

As shown in FIG. 8, when the retractable handle assembly is mounted on a gardening tool 90, such as a pair of gardening shears, the retractable pipe 60 is movable relative to the extension pipe 20 by rotation of the rotation member 30 to adjust the distance between the retractable pipe 60 and the extension pipe 20 so as to adjust the whole length of the retractable handle assembly, thereby facilitating a user operating the gardening tool 90.

Accordingly, the retractable pipe 60 is movable relative to the extension pipe 20 by rotation of the rotation member 30 to adjust the distance between the retractable pipe 60 and the extension pipe 20 so as to adjust the whole length of the retractable handle assembly, thereby facilitating a user operating the gardening tool 90. In addition, when the control member 50 is rotated by the rotation member 30, each of the push flanges 51 of the control member 50 is movable to press the resting portion 83 of the respective flexible arm 86 of the expandable member 80 to push the pressing portion 84 of the respective flexible arm 86 of the expandable member 80 to press the inner wall of the extension pipe 20 so as to lock the retractable pipe 60 onto the extension pipe 20. Further, when each of the push flanges 51 of the control member 50 is inserted into the locking recess 85 of the respective flexible arm 86 of the expandable member 80 by rotation of the control member 50, the control member 50 is locked by the expandable member 80, thereby preventing the control member 50 from being jammed due to an excessive rotation. Further, when the control member 50 is locked by the expandable member 80, the rotation member 30 is locked by the control member 50, thereby preventing the rotation member 30 from being rotated freely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A retractable handle assembly, comprising:

a shank;

an extension pipe mounted in the shank;

a retractable pipe movably mounted in the extension pipe;

a receiving member mounted on the retractable pipe to move therewith;

an expandable member mounted on the receiving member to move therewith;

a control member extended through the expandable member and rotatable between a first position where the expandable member is pressed outwardly by the control member to press the extension pipe so as to lock the retractable pipe onto the extension pipe and a second position where the expandable member is loosened from the control member to release the extension pipe so as to unlock the retractable pipe from the extension pipe;

a driving member secured on the control member to rotate the control member;

a rotation member rotatably on the shank and connected to the driving member to rotate the driving member;

wherein the expandable member has two opposite flexible arms each having a first face formed with a resting portion and a locking recess and a second face formed with a pressing portion that is movable to press an inner wall of the extension pipe.

2. The retractable handle assembly in accordance with claim 1, wherein the control member has a periphery formed with two opposite push flanges each movable by rotation of the control member to press the resting portion of a respective flexible arm of the expandable member to push the pressing portion of the respective flexible arm of the expandable member toward the extension pipe.

3. The retractable handle assembly in accordance with claim 1, wherein each of the push flanges of the control member is inserted into and detachably locked in the locking recess of the respective flexible arm of the expandable member by rotation of the control member to lock the control member onto the expandable member.

4. The retractable handle assembly in accordance with claim 1, wherein the expandable member has an inside formed with a conduit to allow passage of the control member.

5. The retractable handle assembly in accordance with claim 4, wherein the conduit of the expandable member is located between the flexible arms.

6. The retractable handle assembly in accordance with claim 4, wherein the conduit of the expandable member has a side formed with a slit so that the flexible arms are made elastic.

7. The retractable handle assembly in accordance with claim 1, wherein the resting portion of each of the flexible arms of the expandable member is substantially arc-shaped.

8. The retractable handle assembly in accordance with claim 1, wherein the shank has an inside formed with a non-circular positioning hole to position the extension pipe.

9. The retractable handle assembly in accordance with claim 8, wherein the positioning hole of the shank has a bottom formed with a passage, the rotation member has an inside formed with a counterbore, the driving member has a first end received in the shank and a second end extended through the passage of the shank and fixed in the counterbore of the rotation member.

10. The retractable handle assembly in accordance with claim 9, further comprising a locking screw extended through the rotation member and the second end of the driving member and screwed into the control member to combine the rotation member, the driving member and the control member together, and an end cap mounted in the counterbore of the rotation member to cover the locking screw.

11. The retractable handle assembly in accordance with claim 1, wherein the driving member has an inside formed with a fixing hole fixed on the control member, and the control member has a first end secured in the fixing hole of the driving member to rotate therewith and a second end provided with a catch member.

12. The retractable handle assembly in accordance with claim 1, further comprising a sleeve mounted on an upper end of the extension pipe.

13. The retractable handle assembly in accordance with claim 1, wherein the retractable pipe partially protrudes outwardly from the extension pipe and has a non-circular cross-sectional shape matching that of the extension pipe, and the extension pipe partially protrudes outwardly from the shank and has a non-circular cross-sectional shape matching that of the shank.

14. A retractable handle assembly, comprising:

a shank;

an extension pipe mounted in the shank;

a retractable pipe movably mounted in the extension pipe;

a receiving member mounted on the retractable pipe to move therewith;

an expandable member mounted on the receiving member to move therewith;

a control member extended through the expandable member and rotatable between a first position where the expandable member is pressed outwardly by the control member to press the extension pipe so as to lock the retractable pipe onto the extension pipe and a second position where the expandable member is loosened from the control member to release the extension pipe so as to unlock the retractable pipe from the extension pipe;

a driving member secured on the control member to rotate the control member;

a rotation member rotatably on the shank and connected to the driving member to rotate the driving member;

wherein the shank has a lower end provided with two limit studs, and the rotation member has a peripheral wall formed with two limit slots to receive the limit studs of the shank.

15. The retractable handle assembly in accordance with claim 14, wherein the limit studs of the shank are rotatable in the limit slots of the rotation member to limit rotation of the rotation member.

16. The retractable handle assembly in accordance with claim 14, wherein the rotation member is rotatably on the lower end of the shank.

17. A retractable handle assembly, comprising:

a shank;

an extension pipe mounted in the shank;

a retractable pipe movably mounted in the extension pipe;

a receiving member mounted on the retractable pipe to move therewith;

an expandable member mounted on the receiving member to move therewith;

a control member extended through the expandable member and rotatable between a first position where the expandable member is pressed outwardly by the control member to press the extension pipe so as to lock the retractable pipe onto the extension pipe and a second position where the expandable member is loosened from the control member to release the extension pipe so as to unlock the retractable pipe from the extension pipe;

a driving member secured on the control member to rotate the control member;

a rotation member rotatably on the shank and connected to the driving member to rotate the driving member;

wherein the receiving member has an inside formed with a channel to allow passage of the control member;

the receiving member has a first end inserted into the retractable pipe and a second end formed with a receiving chamber connected to the channel to receive the expandable member;

the first end of the receiving member has a peripheral wall formed with two locking bores, and the retractable pipe has a lower end formed with two locking bosses snapped into the locking bores of the receiving member.

* * * * *